United States Patent [19]

Johnson et al.

[11] 4,150,680

[45] Apr. 24, 1979

[54] DISHWASHER SOIL SEPARATOR

[75] Inventors: Philip P. Johnson; Geoffrey L. Dingler, both of St. Joseph, Mich.

[73] Assignee: Whirlpool Corporation, Benton Harbor, Mich.

[21] Appl. No.: 909,778

[22] Filed: May 26, 1978

[51] Int. Cl.[2] ..... B08B 3/02

[52] U.S. Cl. ..... 134/104; 134/176

[58] Field of Search ..... 242/104, 109, 111, 176, 242/186

[56] References Cited

U.S. PATENT DOCUMENTS

| | | | |
|---|---|---|---|
| 1,971,588 | 8/1934 | Stoddard et al. | 134/104 UX |
| 2,570,021 | 10/1951 | Beach | 134/111 X |
| 2,657,695 | 11/1953 | Walker | 134/111 |
| 2,700,978 | 2/1955 | Pietsch | 134/186 |
| 3,090,391 | 5/1963 | Kaldenberg et al. | 134/176 |
| 3,765,430 | 10/1973 | Muller | 134/109 |

*Primary Examiner*—George F. Mautz

*Attorney, Agent, or Firm*—Wegner, Stellman, McCord, Wiles & Wood

[57] ABSTRACT

A dishwasher having improved structure for separating food soil and the like from the dishwashing liquid. The soil separating structure is associated with a suction passage leading to a circulation pump of the dishwasher provided for effecting circulation of the dishwashing liquid from a lower sump portion of the dishwasher receptacle back to the dishwashing space for washing dishes and the like therein. The soil separator includes an accumulator wherein the soil is collected for subsequent discharge as desired and structure responsive to a centrifugal action in the suction passage for effecting a circulation of a portion of the dishwashing liquid between the suction passage and the accumulator. The structure is arranged to utilize the combined swirling and longitudinal movement of the dishwashing liquid in the suction passage for effecting the desired soil separation by centrifugal action. The discharge of the collected soil may be effected by a suitable drain pump connected to the accumulator. The swirling movement of the dishwashing liquid in the suction passage may be effected by a rotary impeller, the circulation of the dishwashing liquid in the dishwashing space may be effected by a centrifugal circulation pump, and the draining of the system may be effected by a rotary drain pump. In the illustrated embodiment, each of the impeller, circulation pump and drain pump is coaxially carried on a common shaft of a single drive motor.

7 Claims, 5 Drawing Figures

24
3.
46
32
39
26
15
33
25
38
3.
45

39
15
24
26
34
30
33
35
18
32
23
46
45
27

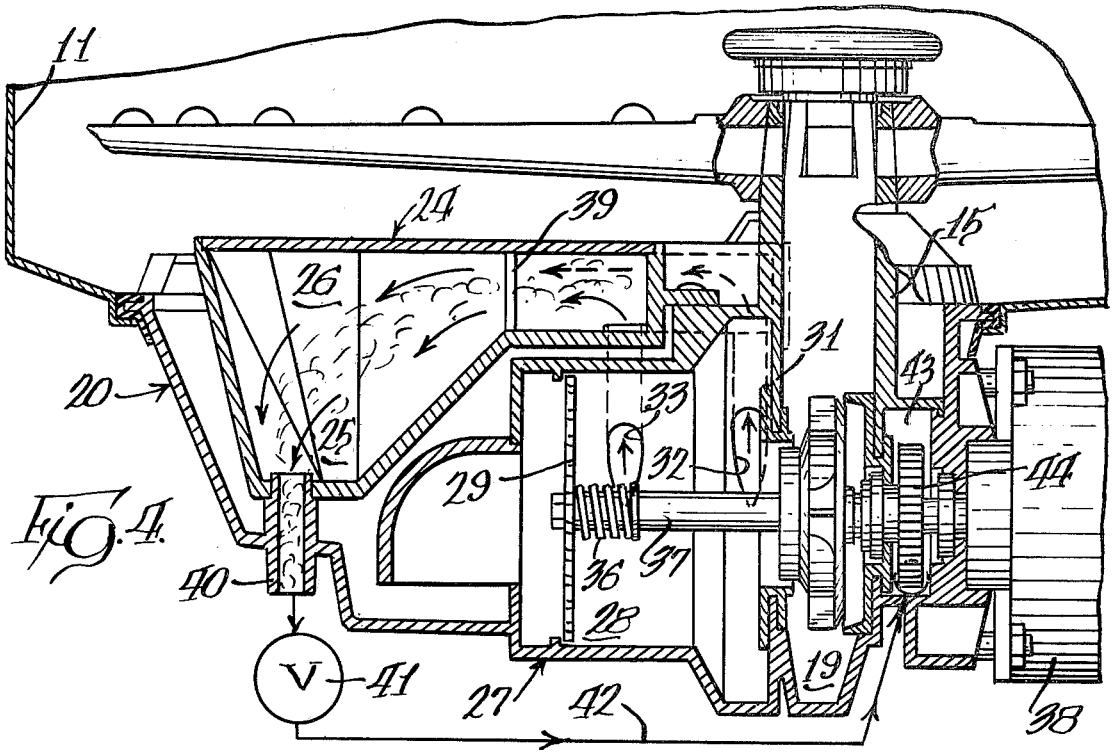
Fig. 4.
Fig. 5.
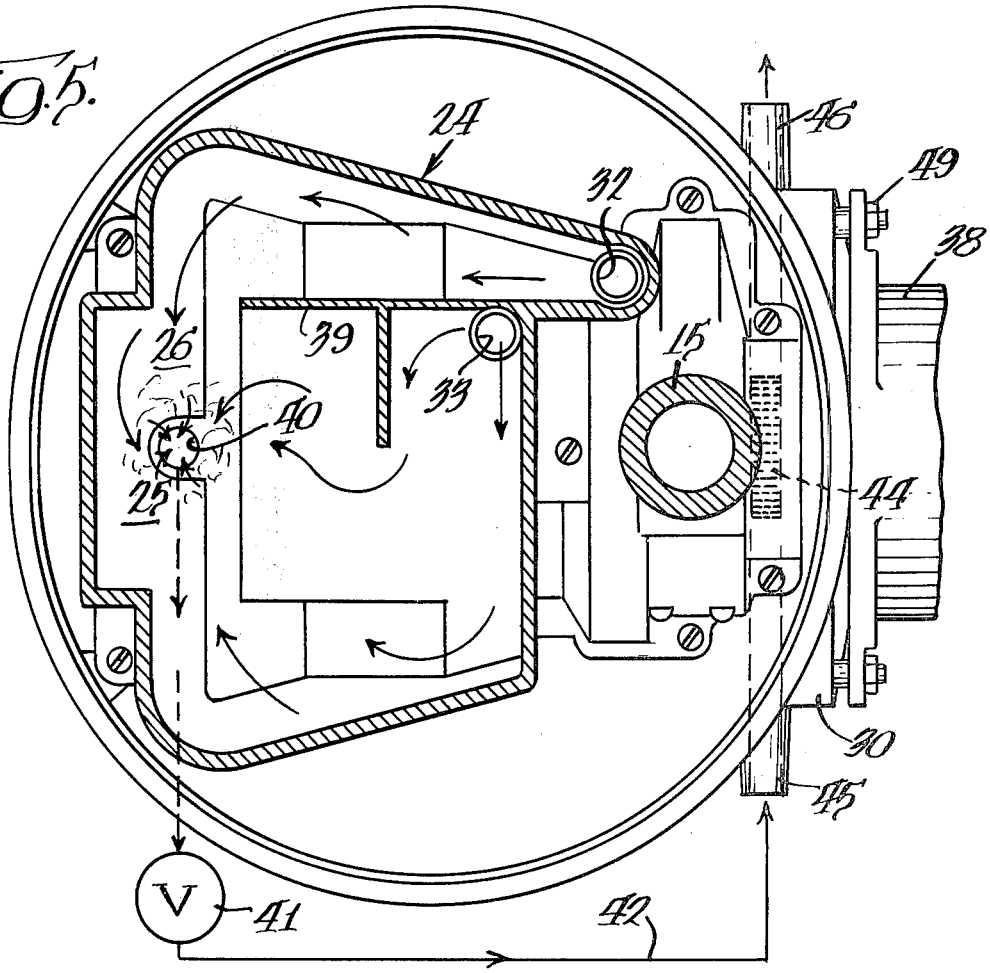

DISHWASHER SOIL SEPARATOR

BACKGROUND OF THE INVENTION

1. Field of the Invention

This invention relates to dishwashers and in particular to means for separating soil from the dishwashing liquid in an automatic dishwashing appliance.

2. Description of the Prior Art

In one conventional form of automatic dishwashing appliance, dishwashing liquid is circulated through a dishwashing space by means of a circulation pump. The dishwashing liquid is collected in a sump portion of the receptacle defining the dishwashing space and is delivered to the pump through a suction passage. The pump discharges the dishwashing liquid through a delivery passage, such as to a rotary spray arm for spraying the dishes in the dishwashing space, or to other conventional means for delivering the dishwashing liquid in washing association with the dishes.

During the course of the dishwashing operation, soil, such as particulate food material, is picked up by the dishwashing liquid. It is desirable to separate the soil from the liquid so as to minimize the subsequent rinsing operations necessary to complete thorough cleaning of the dishes. A number of different devices have been developed for effecting such soil separation.

Illustratively, in U.S. Pat. No. 1,971,588 of Edgar S. Stoddard et al, a dishwashing machine is shown wherein the dishwashing liquid is delivered to a sump adjacent a rotary impeller. The impeller and sump are cooperatively arranged so as to cause the particulate material to move outwardly towards the circumferential wall portion of the sump and then downwardly along a bottom wall portion thereof into a collecting chamber. The impeller acts on the liquid inwardly of the circumferential wall of the sump so as to throw the dishwashing liquid, which has been thusly freed of a portion of the soil, back into the dishwashing space. The collected soil may be discharged through a drain duct by suitable valve control means.

Forrest A. Walker shows, in U.S. Pat. No. 2,657,695, a dishwashing apparatus provided with a centrifugal separation pump wherein the soil is carried down into a vat by the downflow of the dishwashing liquid to be forced outwardly by the centrifugal action of the impeller toward an outside wall of the sump. A perforated barrier is provided inwardly of the sump space so as to intercept food particles tending to move to the impeller thereby holding the soil in the sump space between the perforated barrier and the outer sump wall.

In U.S. Pat. No. 2,700,973 of Joseph A. Pietsch, a dishwasher with a soil separation chamber is shown wherein the dishwashing liquid is caused to flow along an inclined wall into overlying relationship with a depending sump portion in which the soil tends to collect.

Helmut Muller, in U.S. Pat. No. 3,765,430, shows an automatic dish rinsing machine having a centrifugal force separator wherein the circulation pump includes a second outlet for delivering a portion of the dishwashing liquid to a centrifugal separator in parallel with the main return flow of the dishwashing liquid to the dishwashing space.

SUMMARY OF THE INVENTION

The present invention comprehends a dishwasher structure having an improved means for effecting removal of soil from the dishwashing liquid in the operation of the dishwasher.

More specifically, the invention comprehends the provision in a dishwasher having a receptacle defining a dishwashing space, a circulation pump having an inlet and an outlet means, a suction passage connecting a lower portion of the receptacle to the inlet of the pump, a means defining a delivery passage connecting the outlet of the pump to an inlet to the dishwashing space whereby dishwashing liquid may be circulated through said dishwashing space for washing dishes therein, of an accumulator defining a settling space and a flow conducting space having an inlet and an outlet, a separator associated with the suction passage and having first and second ports connecting with the flow conducting space inlet and outlet respectively, means for urging the dishwashing liquid in the suction passage toward each of the ports, the ports and liquid urging means being cooperatively arranged to cause a pressure condition of the dishwashing liquid developed at the first port to be higher than the pressure condition thereof developed at the second port thereby causing a portion of the dishwashing liquid being delivered to the pump through the suction passage to be directed through the first port into the settling tank to have particulate matter in the diverted portion of the dishwashing liquid settle out therefrom into the settling space, the diverted portion being returned to the suction passage through the second port as a result of the pressure differential existing between the ports, and means for selectively discharging the settled-out particulate material from the settling tank.

The means for selectively discharging the settled-out particulate material may include a valved outlet which may be arranged to provide discharge of the dishwashing liquid through the accumulator whereby the dishwashing liquid may flow through the acumulator to the valved outlet carrying with it the collected soil for discharge, such as to a conventional drain.

The means for effecting the swirling movement of the dishwashing liquid in the suction passage may comprise a rotary impeller within the suction passage, and more specifically, a rotary impeller disposed therein upstream of the ports. The differential pressure between the ports may be effected by suitably locating the ports relative to the axis of the rotary impeller and the path of swirling movement of the liquid through the suction passage.

More specifically, the first port may be spaced from the axis a greater distance than that of the second port.

Further, in the illustrated embodiment, the ports are axially spaced for improved circulation flow during the soil separating operation.

In the illustrated embodiment, the impeller, the rotary drain pump, and the circulation pump may be coaxially mounted to a common shaft of a single drive motor for improved construction economies.

The dishwasher structure of the present invention is extremely simple and economical of construction while yet providing the highly desirable improved functioning discussed above.

BRIEF DESCRIPTION OF THE DRAWING

Other features and advantages of the invention will be apparent from the following description taken in connection with the accompanying drawing wherein:

FIG. 4 is a fragmentary vertical section similar to that of FIG. 1 but illustrating the arrangement of the structure in effecting a draining of the dishwasher tub and a discharge of the collected soil; and FIG. 5 is a fragmentary horizontal section similar to that of FIG. 2 but illustrating the flow of the dishwasher liquid in the drain cycle illustrated in FIG. 4.

DESCRIPTION OF THE PREFERRED EMBODIMENT

Figure 1:
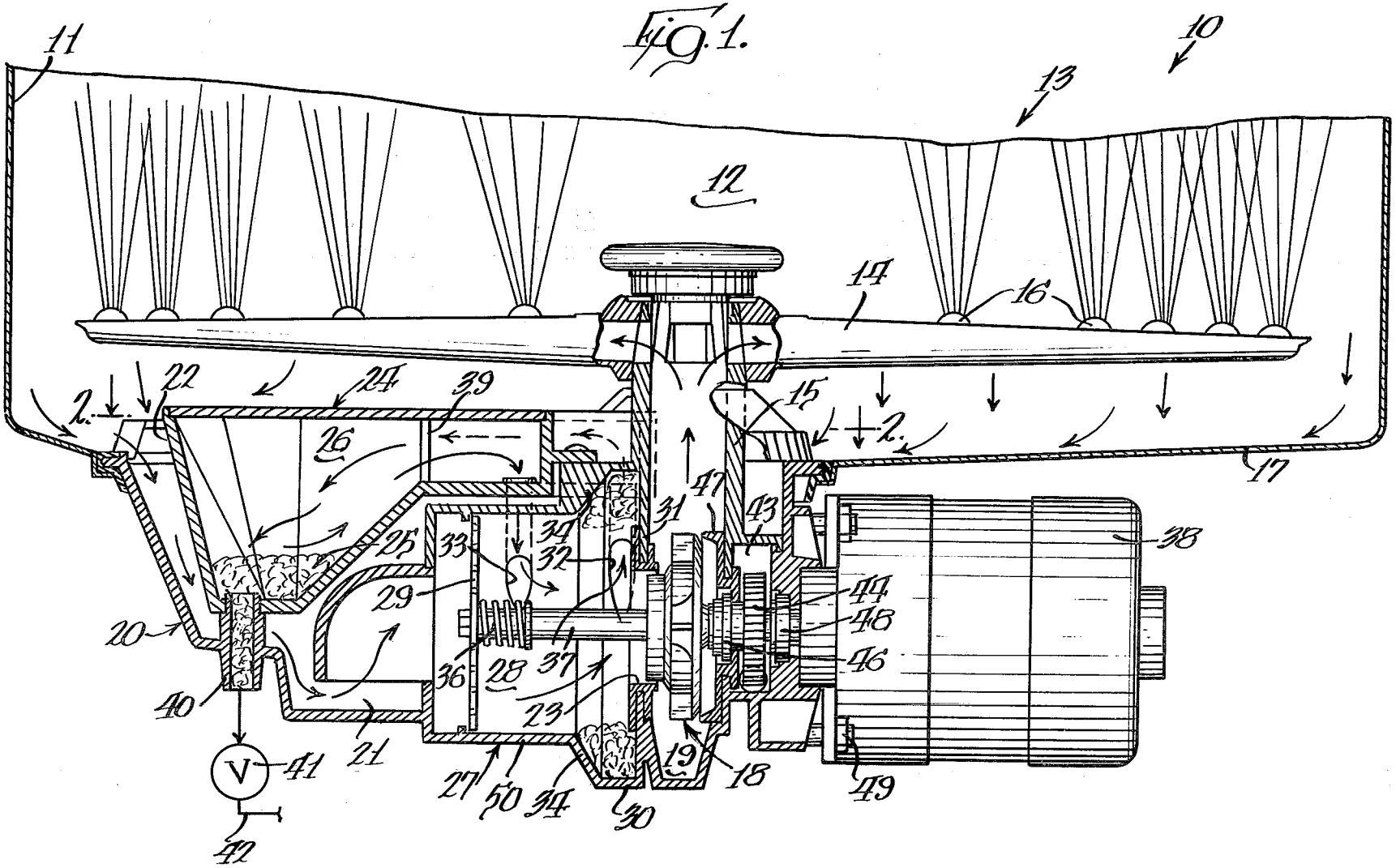
FIG. 1 is a fragmentary vertical section of a dishwasher structure having a soil separating means embodying the invention.

In the exemplary embodiment of the invention as dislosed in the drawing, a washing appliance generally designated 10 illustratively comprises a dishwasher having a tub 11 defining a dishwashing space 12. Dishes to be washed (not shown) are disposed within the space 12 to be washed by means of a plurality of jets 13 delivered from a rotating spray arm 14 in a conventional manner. The spray arm may be carried rotatably on a hollow shaft 15 which conducts the washing liquid upwardly into the spray arms and outwardly through suitable apertured outlets 16 on the spray arm. The lower portion 17 of the tub 11 defines a sump for collecting the dishwashing liquid.

The dishwashing liquid is circulated to the diswashing space by a centrifugal pump generally designated 18 disposed in a pump chamber 19 at the lower end of shaft 15. Dishwashing liquid is delivered from the sump 17 through a passage 21 defined by a wall structure generally designated 20 having an inlet 22 opening to the sump 17 and an outlet 23 opening to the pump chamber 19.

The passage 21 is further defined by a centrifugal separator 27 including an annular wall defining a separator chamber 28. The chamber 28 opens through the outlet 23 into the pump chamber 19. Separator 27 includes a rotary perforate separating impeller 29 for swirling the dishwashing liquid as it flows through the separator. An auxiliary portion of the passage 21 is defined by an accumulator 24 having a lower settling space 25 and an upper flow conducting space 26.

As shown in FIG. 1, the separator 27 and circulating pump 18 may be defined by a common housing portion 30 arranged to define both the separator chamber 28 and pump chamber 19.

Figure 2:
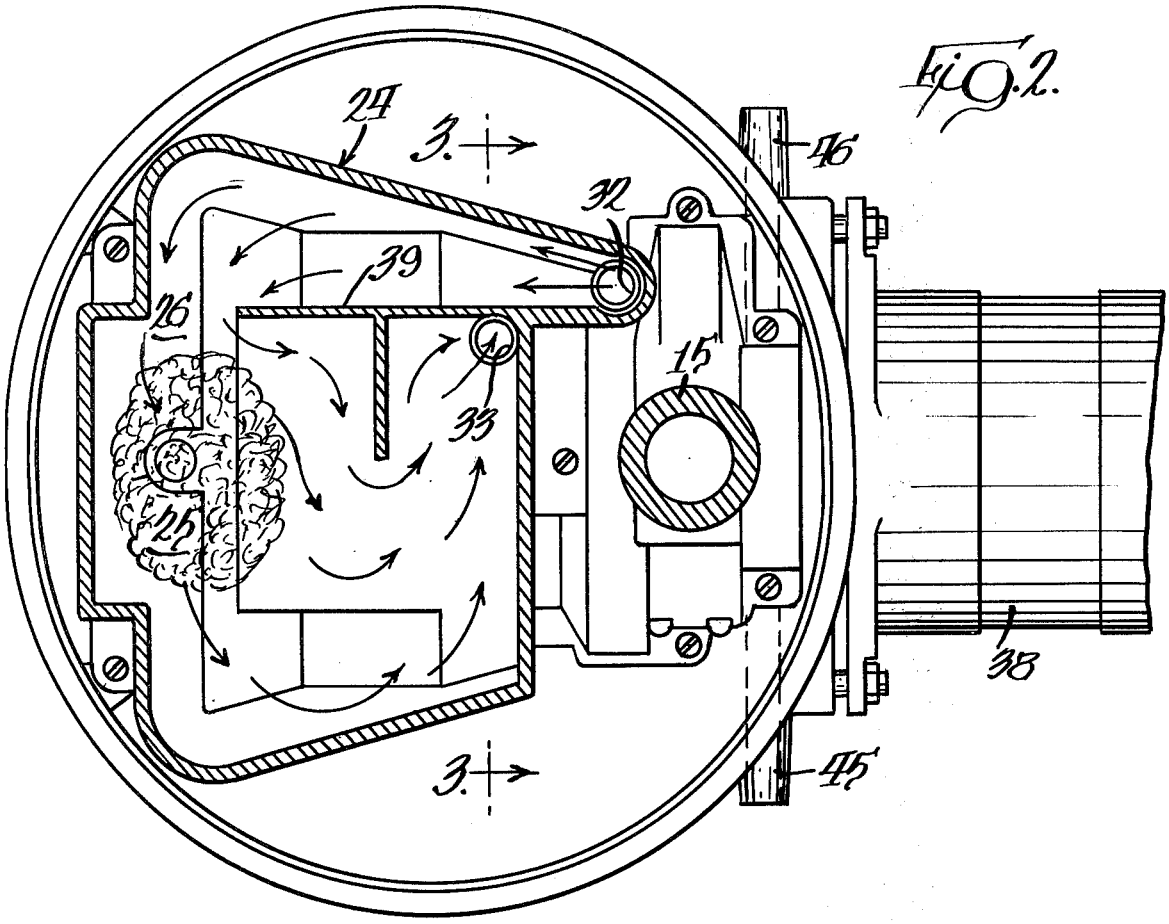
FIG. 2 is a fragmentary horizontal section taken substantially along the line 2—2 of FIG. 1.
Figure 3:
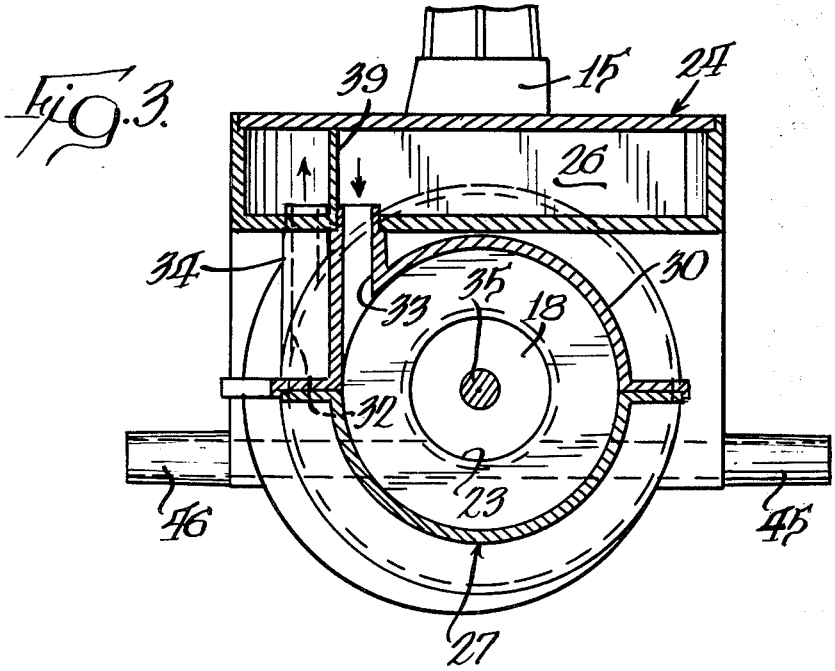
FIG. 3 is a fragmentary vertical section taken substantially along the line 3—3 of FIG. 2.

The separator 27 is further defined by a pair of openings 32 and 33 in housing 30 communicating with the flow conducting space 26 of the accumulator 24. As shown in FIGS. 2 and 3, opening 32 is provided in an annulus 34 of the housing 30 so as to having a greater spacing from the axis 35 of the separator space 28 than the spacing of the opening 33 therefrom. Opening 23 may be defined by a transverse wall providing controlled flow of the dishwashing liquid to the pump 18 and acting in the manner of a baffle at the downstream side of the annular space defined by annulus 34 to provide improved directing of the soil and food particles into the annular space. Impeller 29 is carried on the end 36 of a drive shaft 37 driven by an electric motor 38 at about 3400 RPM so as to swirl the dishwashing liquid in separator space 28 about axis 35 at relatively high speed and thereby cause centrifugal separation of soil in the wash water. As best shown in FIG. 1, the centrifugally separated soil, as a result of the concurrent longitudinal flow of the wash water through the separator, tends to collect in the annulus 34 where it can be bled off through opening 32 to accumulator 24.

In the illustrated embodiment, the openings 32 and 33 are arranged substantially tangentially to the wall of the separator chamber 28. By locating the openings at different radial dimensions, a slight pressure differential is created between the openings with the greater pressure occurring at the larger radius opening 32. Thus, as soil collects in the annulus 34, it can be bled off and circulated through the accumulator where it settles out in the space 25.

In the illustrated embodiment, the flow rate through the accumulator is about one-half gallon per minute ($\frac{1}{2}$ gpm). The flow rate can be controlled by adjusting the orientation of the openings relative to tangency with the wall of chamber 28 and it should be noted that tangency is not critical to the successful utilization of the concepts of the invention. As will be explained below, it is important that the size of the openings be great enough to allow substantially greater flow than the $\frac{1}{2}$ gpm occurring during soil collection.

As shown in FIG. 2, the accumulator 24 defines a plurality of internal baffle walls 39 which conduct the dishwashing fluid through the flow conducting space 26 in such a manner as to flow over the settling space 25 in passing to the outlet opening 33. As the dishwashing liquid flows over the settling space, soil particles and the like settle out in the settling space 25.

Thus, the dishwashing liquid is continuously cleansed by separating out therefrom of food particles and soil as the dishwashing liquid flows through the accumulator.

A discharge tube 40 from accumulator 24 is connected through a conventional solenoid valve 41 and a transfer line 42 to a drain pump chamber 43 in which a drain pump 44 carried on motor shaft 37 is disposed. As seen in FIG. 5, housing 30 defines an inlet 45 to the drain pump chamber 43 and an outlet 46 extending therefrom for discharging the drained dishwashing liquid as desired, such as to a drain (not shown).

In the operation of the dishwasher, a suitable quantity of dishwashing liquid is introduced into the tub 11. To effect the washing of the dishes, motor 38 is suitably energized so as to cause operation of pump 18. The dishwashing liquid collected in the sump portion 17 of the tub passes downwardly through the suction passage 21 to the pump chamber 19 wherein the pump 18 forcibly pumps the dishwashing liquid up through the hollow shaft 15 and spray arm 14 to provide the dishwashing jets 18 as discussed above. The sprayed dishwashing liquid then falls back to the sump for recirculation by the pump in this manner.

As food particles and soil are washed from the dishes, they are entrained in the dishwashing liquid as it is brought back through the suction passage 21 toward pump 18. The food particles and soil are centrifugally separated from the returning dishwashing liquid by the action of separator 27 and collected in accumulator 24. Thus, as the dishwashing liquid carrying the soil passes through the separator 27, the impeller 29 thereof causes a swirling movement about the axis 35 of the separator chamber. The centrifugal movement of the dishwashing liquid causes separation of entrained soil and as a result of the pressure differential between openings 32 and 33, as discussed above, a portion of the dishwashing liquid containing concentrated soil is circulated through accumulator 24 wherein the soil settles out in space 25. Since the soil and the other particulate material is dropped from the flowing liquid into the settling portion 25, as shown in FIG. 1, relatively clean dishwashing liquid is returned to the separator space 28 through the opening 33 for flow from the separator space through opening 23 into the pump chamber 19. The thusly cleaned dishwashing liquid is then pumped by pump 18 through the spray arm 14 as discussed above for an improved further cleaning of dishes and the like in the dishwashing space 12.

When it is desired to drain the dishwasher, the valve 41 is opened. Dishwashing liquid is caused to flow outwardly through both openings 32 and 33 concurrently as a result of the negative pressure in the accumulator caused by operation of the drain pump now in communication with the accumulator settling space 25 through the open valve 41. The dishwashing liquid passes from openings 32 and 33 through the flow conducting space 26 and settling space 25, through discharge tube 40 and transfer line 42, to the drain pump 44 for discharge to drain through the drain connection 46 as discussed above. This flow of the dishwashing liquid effectively flushes out the settling portion 25 so as to effectively rid the dishwasher of the accumulated soil which had been removed from the dishwashing liquid during the dishwashing operation as discussed above. Thus, the apparatus provides a self-cleansing functioning every time the dishwasher is drained, eliminating the collected food material in a novel and simple manner.

In order to obtain the desired effective flushing action, a relatively high flow rate of liquid is provided by making the openings 32 and 33, through which the dishwashing liquid is drawn by the drain pump, to be of relatively large size to allow for the quick passage of large quantities of water. As discussed above, the orientation of the openings 32 and 33 may be adjusted so as to permit the desired low flow rate necessary to allow soil to settle in the accumulator 24 during operation of the circulating pump while allowing the high flow rate necessary to flush out the accumulator during operation of the drain pump.

Thus, the invention comprehends providing means in the separator portion of the system for causing a swirling movement about the longitudinal axis of the separator of the dishwashing liquid flowing therethrough toward the recirculating pump. The accumulator defines means for automatically extracting particulate material from the dishwashing liquid and includes means for separating the particulate material as the result of a circulation of a portion of the dishwashing liquid from and to the suction passage during the recirculating operation of the dishwashing pump.

The foregoing disclosure of specific embodiments is illustrative of the broad inventive concepts comprehended by the invention.

We claim:

1. In a dishwasher having a receptacle defining a dishwashing space, a circulation pump having an inlet and an outlet, means defining a suction passage connecting a lower portion of the receptacle to the inlet of the pump, and means defining a delivery passage connecting the outlet of the pump to an inlet to the dishwashing space wherein dishwashing liquid may be circulated through said dishwashing space for washing dishes therein by removing food particles and soil therefrom, the improvement comprising:

an accumulator defining a settling space portion and a flow conducting portion having an inlet and an outlet;

a separator defining a portion of said suction passage and having an annular outer wall provided with first and second ports connecting with said flow conducting space portion inlet and outlet respectively, said first port being at a greater radial distance from the axis of said annular outer wall than the radial distance of said second port from said axis, and means for swirling the dishwashing liquid flowing through said separator passage portion to urge the food particles and soil centrifugally outwardly toward said annular outer wall, said port, pump, and swirling means being cooperatively arranged to cause a pressure condition of the dishwashing liquid developed at said first port to be higher than the pressure condition thereof developed at said second port thereby causing a portion of the dishwashing liquid being delivered toward said pump in said separator passage portion to be diverted through said first port into said flow conducting space portion of the accumulator to have said food particles and soil in the diverted portion of the dishwashing liquid settle out therefrom into said settling space portion and the cleansed diverted portion to be returned to said separator passage portion through said second port as a result of the pressure differential existing between said ports; and means for selectively discharging the settled-out food particles and soil from said settling tank.

2. The dishwasher apparatus of claim 1 wherein said second port is upstream of siad first port relative to the flow of dishwashing liquid through said suction passage portion to said circulation pump inlet.

3. The dishwasher apparatus of claim 1 wherein said settling space narrows downwardly and said means for selectively discharging the settled-out food particles and soil comprises a valved outlet from the lower end of said settling space.

4. The dishwasher apparatus of claim 1 wherein said means for swirling the dishwashing liquid comprises a rotary impeller, said first port being spaced from the axis of said rotary impeller a greater distance than that of the second port from said axis.

5. The dishwasher apparatus of claim 1 wherein said means for selectively discharging the settled-out food particles and soil comprises a valved outlet from the settling space and a drain pump and said second port opens in the direction of swirling of the dishwashing liquid whereby the swirling dishwashing liquid flowing past said second port urges liquid into said separator from said second port during a pump out operation of said apparatus.

6. The dishwasher apparatus of claim 1 wherein said second port is disposed downstream of and adjacent said swirling means.

7. The dishwasher apparatus of claim 1 wherein said first and second ports are spaced apart axially of the annular outer wall a major portion of the axial length of said annular outer wall.

* * * * *

UNITED STATES PATENT AND TRADEMARK OFFICE

CERTIFICATE OF CORRECTION

PATENT NO. : 4,150,680

DATED : April 24, 1979

INVENTOR(S) : Philip P. Johnson and Geoffrey L. Dingler

It is certified that error appears in the above-identified patent and that said Letters Patent are hereby corrected as shown below:

Column 6, Claim 1, line 4, after "conducting" insert --space--.

Column 6, Claim 1, line 16, cancel the last word "port" and substitute therefor --ports--.

Column 6, Claim 2, line 36, after "of" cancel "siad" and substitute therefor --said--.

Signed and Sealed this

*Eleventh* Day of *September 1979*

[SEAL]

*Attest:*

*Attesting Officer*

LUTRELLE F. PARKER

*Acting Commissioner of Patents and Trademarks*